US008714167B2

(12) United States Patent
Yoon et al.

(10) Patent No.: US 8,714,167 B2
(45) Date of Patent: May 6, 2014

(54) DISHWASHER

(75) Inventors: Sangheon Yoon, Seoul (KR); Moonkee Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 851 days.

(21) Appl. No.: 12/827,242

(22) Filed: Jun. 30, 2010

(65) Prior Publication Data

US 2011/0120508 A1 May 26, 2011

(30) Foreign Application Priority Data

Nov. 25, 2009 (KR) ..... 10-2009-0114701

(51) Int. Cl.

| | |
|---|---|
| ***B08B 3/00*** | (2006.01) |
| ***B08B 3/04*** | (2006.01) |
| *B01D 33/00* | (2006.01) |
| *B01D 35/00* | (2006.01) |

(52) U.S. Cl.

USPC ..... 134/104.1; 134/56 D; 134/57 D; 134/58 D; 210/107; 210/338; 210/780

(58) Field of Classification Search

USPC ..... 134/104.1

See application file for complete search history.

(56) References Cited

U.S. PATENT DOCUMENTS

| | | | | |
|---|---|---|---|---|
| 4,217,220 | A | 8/1980 | Egli et al. | |
| 4,754,770 | A | 7/1988 | Fornasari | |
| 5,328,617 | A | 7/1994 | De Haan et al. | |
| 5,450,868 | A | 9/1995 | Young, Jr. | |
| 2006/0237049 | A1 * | 10/2006 | Weaver et al. | 134/56 D |
| 2009/0032061 | A1 | 2/2009 | Beer et al. | |

FOREIGN PATENT DOCUMENTS

| | | | | |
|---|---|---|---|---|
| CH | 169630 | | 8/1934 | |
| DE | 4131914 | A1 * | 4/1993 | A47L 15/42 |
| DE | 100 46 349 | | 3/2002 | |
| DE | 10 2004 004 104 | | 7/2004 | |
| DE | 102007060196 | A1 * | 6/2009 | A47L 15/42 |
| WO | WO 2007/017330 | | 2/2007 | |

OTHER PUBLICATIONS

Kaefferlein, Heinz, "DE4131914A1 English Machine Translation.pdf", Apr. 1, 1993—Machine translation from Espacenet.com.*

Classen et al., "DE102007060196A1 English Machine Translation.pdf", Jun. 18, 2009—Machine translation from Espacenet.com.*

Dictionary.com, "Gear (Dictionary.com).pdf", http://dictionary.reference.com/browse/gear, p. 2.*

German Office Action issued in German Application No. 10 2010 036 845.8 dated Jun. 20, 2011.

(Continued)

*Primary Examiner* — Michael Barr
*Assistant Examiner* — Levon J Shahinian
(74) *Attorney, Agent, or Firm* — KED & Associates, LLP

(57) ABSTRACT

A dishwasher is provided that effectively cleans a filter. The dishwasher may include a rack positioned in a washing space and at least one nozzle that directs washing fluid into the washing space, a sump that receives washing fluid to be supplied to the washing space, and a filter device provided in the sump, including a first filter and a second filter. A driver rotates the first filter or the second filter so as to separate foreign materials from the filter device and prevent the filter device from clogging.

10 Claims, 15 Drawing Sheets

(56) References Cited

OTHER PUBLICATIONS

U.S. Office Action issued in U.S. Appl. No. 12/827,160 dated Dec. 17, 2012.
U.S. Notice of Allowance issued in U.S. Appl. No. 12/827,160 dated May 15, 2013.
U.S. Office Action issued in U.S. Appl. No. 12/827,201 dated Jun. 5, 2013.
U.S. Office Action issued in U.S. Appl. No. 13/076,890 dated Jul. 23, 2013.
U.S. Final Office Action issued in U.S. Appl. No. 13/076,890 dated Jan. 29, 2014.

* cited by examiner

DISHWASHER

CROSS-REFERENCE TO RELATED APPLICATION

This application claims priority under 35 U.S.C. §119 application and 35 U.S.C. §365 to Korean Patent Application No. 10-2009-0114701, filed in Korea on Nov. 25, 2009, which is hereby incorporated by reference in its entirety.

BACKGROUND

1. Field

A dishwasher is provided, and more specifically, a dishwasher is provided that effectively cleans a filter.

2. Background

Generally, a dishwasher supplies clean washing fluid to a sump and then sprays washing fluid onto wash items positioned in the washer using a washing fluid injector to wash the items. The used washing fluid is retrieved to the sump and, filtered by a filter apparatus, and re-supplied to the washing fluid injector. Used washing fluid, together with foreign materials collected in the filter apparatus, may be discharged to the outside of the dishwasher at the end of the washing cycle.

Foreign materials are continuously accumulated in the filter apparatus, and thus the filter apparatus may be clogged by the foreign materials. The foreign materials may generate flow resistance, and thus the flow rate of washing fluid passing through the filter apparatus may be reduced. This reduced flow rate may adversely impact washing performance of the dishwasher, and may overload a washing fluid pump unit that pumps the washing fluid. Additionally, foreign materials adhered to the filter may cause a bad odor inside the washer due to the decay of the foreign materials.

BRIEF DESCRIPTION OF THE DRAWINGS

The embodiments will be described in detail with reference to the following drawings in which like reference numerals refer to like elements wherein.

DETAILED DESCRIPTION

In the following detailed description, reference is made to the accompanying drawings that form a part hereof, and in which is shown by way of illustration various embodiments which are described in sufficient detail to enable those skilled. It is understood that other embodiments may be utilized and that logical structural, mechanical, electrical, and chemical changes may be made without departing from the spirit or scope as embodied and broadly described herein. To avoid detail not necessary to enable those skilled in the art, the description may omit certain information known to those skilled in the art. The following detailed description is, therefore, not to be taken in a limiting sense, and scope is defined only by the appended claims.

Figure 1:
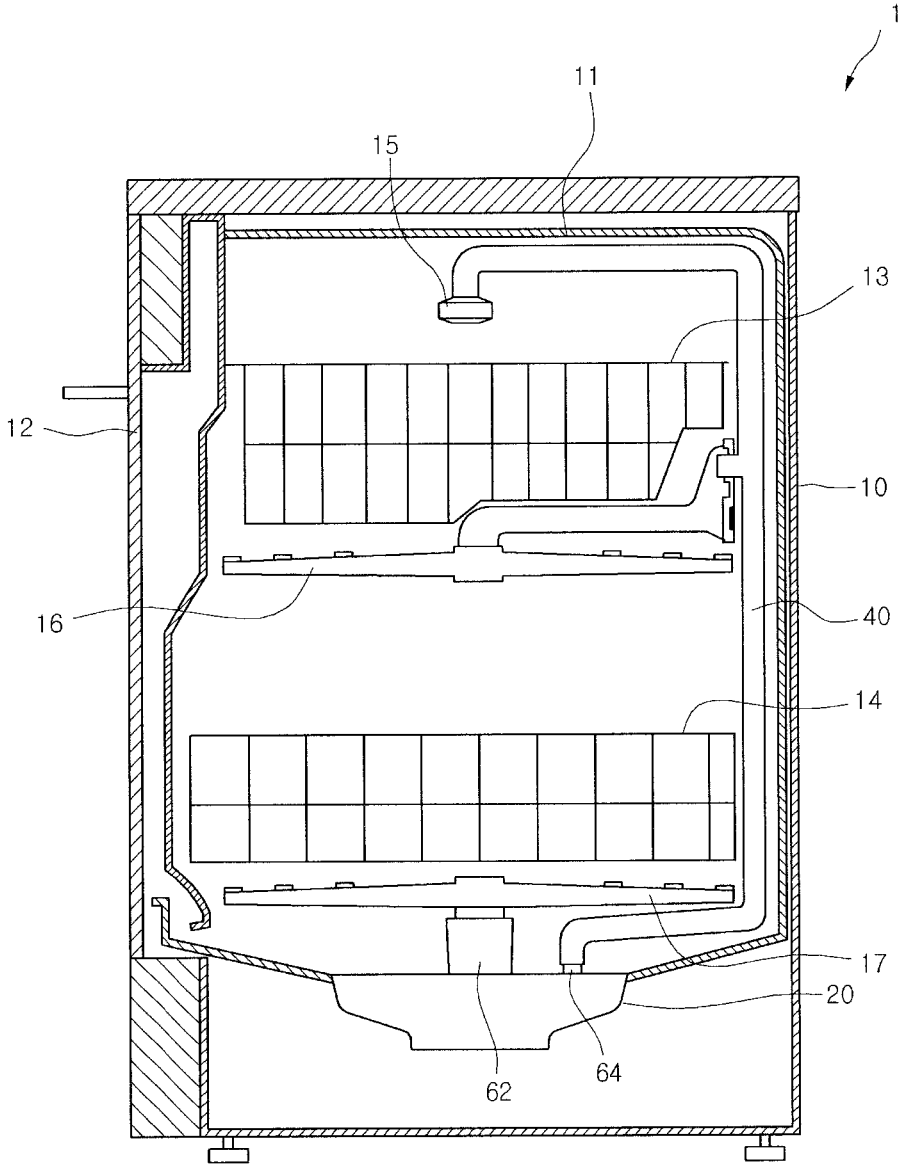
FIG. 1 is a cross-sectional view of a dishwasher according to an embodiment as broadly described herein.
Figure 2:
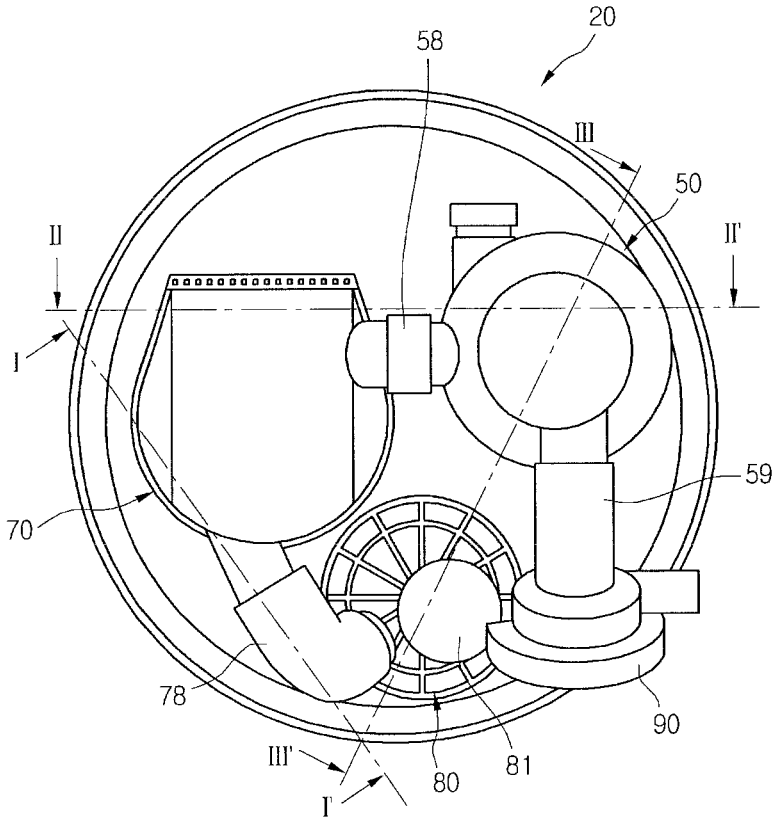
FIG. 2 is a bottom view of a sump of the dishwasher shown in FIG. 1.
Figure 3:
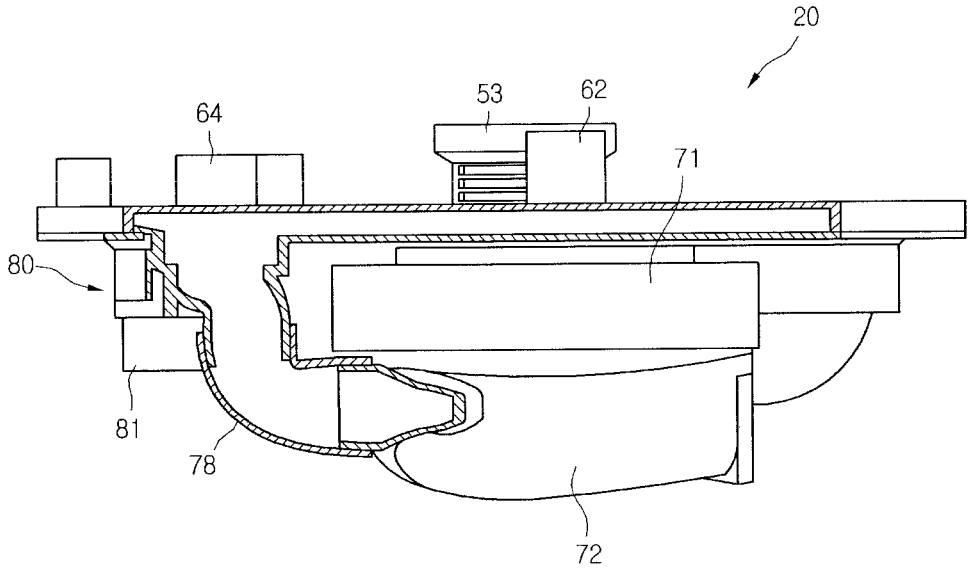
FIG. 3 is a cross-sectional view taken along line I-I' of FIG. 2.
Figure 4:
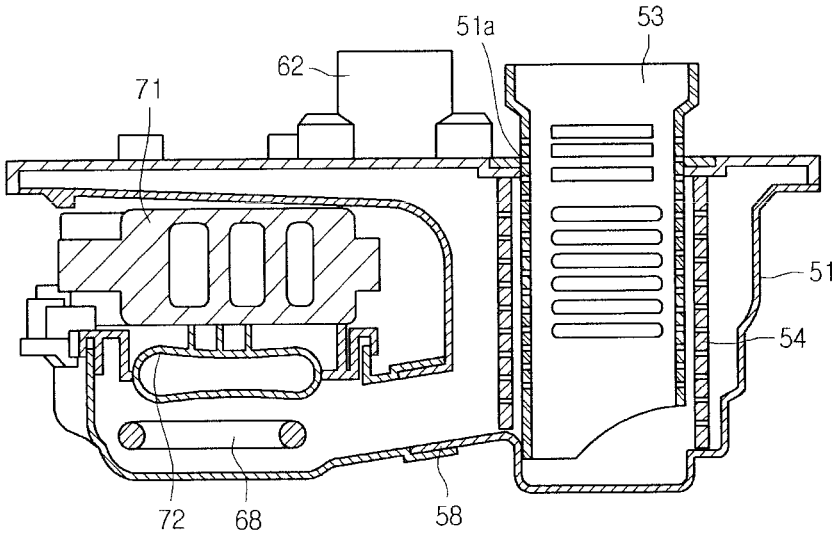
FIG. 4 is a cross-sectional view taken along line II-II' of FIG. 2.
Figure 5:
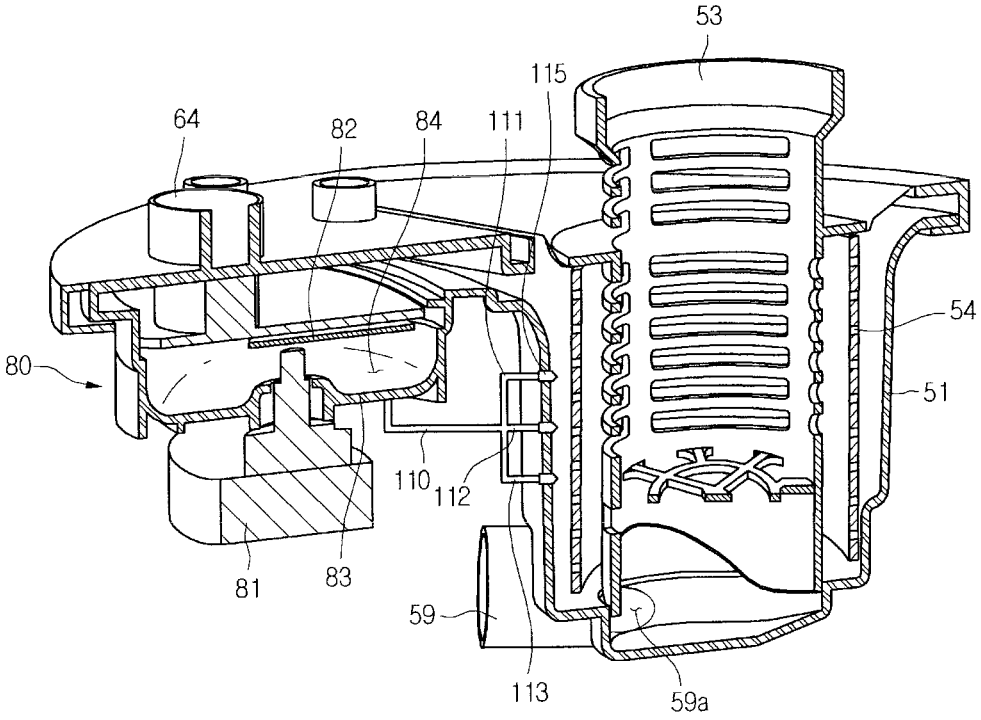
FIG. 5 is a cross-sectional view taken along line III-III' of FIG. 2.

Referring to FIG. 1, a dishwasher 1 according to an embodiment as broadly described herein may include a case 10, a tub 11 that is received inside the case 10 to define a washing space, a door 12 that is provided on a front surface of the tub 11 to open and close the washing space, and a sump 20 that is provided below the tub 11 to store washing fluid. An upper rack 13 may be positioned above lower rack 14 in the tub 11, and may be guided by guide rails provided on inner sides of the tub 11, such that they can be drawn out through the front of the tub 11.

A lower nozzle 17, an upper nozzle 16, and a top nozzle 15 may supply washing fluid from the sump 20 to the inside of the washer. In detail, the lower nozzle 17 may be connected to the upper side of the sump 20 to supply washing fluid to the lower portion of the washer, onto wash items mounted on the lower rack 14. A lower nozzle connector 62 may connect the sump 20 to the lower nozzle 17. The upper nozzle 16 may be positioned at a central portion of the washer to direct washing fluid toward the upper rack 13 and the top nozzle 15 may be positioned at a ceiling portion of the tub 11 to direct washing fluid downward. A washing fluid guide 40 may guide washing fluid toward the upper rack 13 through the top nozzle 15 or the upper nozzle 16. A guide connector 64 connects the sump 20 to the washing fluid guide 40.

Referring to FIGS. 2 to 6, the sump 20 may include a filter device 50 that receives used washing fluid from the tub 11 and filters foreign materials from the washing fluid, a washing pump 70 that pumps the washing fluid filtered by the filter device 50, and a channel opening and closing device 80 that opens and closes a channel that directs the washing fluid passing through the washing pump 70 to the lower nozzle 17 or the washing fluid guide 40.

The filter device 50 may include a first filter 52 that may also form part of a lower surface of the washing space of the tub 11 and has a plurality of holes having a first size, a second filter 53 that is provided inside the sump and has a plurality of holes having a second size larger than the first size, and a third filter 54 that is provided inside the second filter 53 and has a plurality of holes having a third size smaller than the first size. The first filter 52 may be positioned at an upper surface of the sump 20. The second filter 53 and the third filter 54 may be received in a filter housing 51 also positioned in the sump 20.

A filter inlet 51*a* is formed at an upper portion of the filter housing 51 to supply washing fluid to the filter device 50 so that foreign materials are filtered as the washing fluid passes through the first and second filter 52 and 53 and the third filter 54. A pump inlet 58 is formed at a lower portion of the filter housing 51 to supply filtered washing fluid to the washing pump 70. The washing fluid stored in the sump 20 may flow to the pump inlet 58 through the filter device 50 due to the suction force generated by the pump 70.

The washing pump 70 includes a washing motor 71 that provides a driving force and an impeller 72 that rotates in response to the driving force of the washing motor 71. A pump discharging device 78 discharges the washing fluid from the washing pump 70. Washing fluid is supplied to the impeller 72 through the pump inlet 58 and is discharged through the pump discharging device 78 via the impeller 72.

In certain embodiments, a heater 68 may heat the washing fluid flowing through the sump 20 so that wash items may be washed with washing fluid heated to a high temperature by the heater 68, thereby improving washing efficiency and effectiveness.

The pump discharging device 78 is connected to the channel opening and closing device 80. The channel opening and closing device 80 includes an opening and closing valve 82 and an opening and closing driver 81 that drives the opening and closing valve 82. The washing fluid supplied to the channel opening and closing device 80 may flow to the lower nozzle connector 62 or the guide connector 64 through the opening and closing valve 82. In other words, washing fluid flows to the lower nozzle 17 via the lower nozzle connector 62, and to the upper nozzle 16 or the top nozzle 15 via the guide connector 64, based on a position of the valve 82.

The washing fluid guide 40 may include separate channels that communicate with the top nozzle 15 or the upper nozzle 16, respectively, such as, for example, a top nozzle channel and an upper nozzle channel. Washing fluid may flow to the top nozzle channel or the upper nozzle channel under the control of the opening and closing valve 82. The top nozzle 15, the upper nozzle 16, and the lower nozzle 17 may be selectively opened, such that washing fluid may be dispersed through only some of the nozzles 15, 16 and 17, or, all the nozzles 15, 16 and 17 may be opened so that washing fluid may be dispersed through all the nozzles 15, 16 and 17.

A draining pump 90 may be provided to generate a suction force to drain the washing fluid. A draining device 59 may be provided between the filter device 50 and the draining pump 90 to drain the washing fluid and the foreign materials. The draining device 59 may extend outward from a lower end portion of the filter housing 51, in a different direction from the pump inlet 58.

The filter housing 51 may include an outlet 59*a* that communicates with the draining device 59 so as to discharge washing fluid. During a draining cycle, the washing fluid may flow from the filter housing 51 to the draining device 59 through the outlet 59*a*. Alternatively, the outlet 59*a* may instead or also be considered an inlet into the draining device 59. When the draining pump 90 is driven, washing fluid stored in the sump 20 may be discharged to the outside through the draining device 50 and the draining pump 90 together with the foreign materials accumulated in the filter 50.

The channel opening and closing device 80 may include a case 83 that stores washing fluid supplied through the washing pump 70. The case 83 defines a washing fluid storage chamber 84 that stores washing fluid.

A branch channel 110 guides at least a part of the washing fluid stored in the washing water storage chamber 84 to the filter device 50. A main flow path may be defined by a path through the filter device 50, the washing pump 70, the channel opening and closing device 80, and the lower nozzle connector 62 or the guide connector 64.

The branch channel 110 may include a first branch part 111, a second branch part 112, and a third branch part 113 that each branch off from the main branch channel 110. The washing fluid flowing through the branch channel 110 may be directed to the first, second, and third branch parts 111, 112, and 113. Each of the first, second, and third branch parts 111, 112, and 113 may be connected to a nozzle 115 that directs washing fluid toward the second and third filters 53 and 54. The nozzles 115 may extend into the filter housing 51 at different heights so that washing fluid may be uniformly applied to the second and third filters 53 and 54.

As described above, the washing fluid is directed toward the second and third filters 53 and 54 such that foreign materials accumulated in the second and third filters 53 and 54 may be separated from the second and third filters 53 and 54 to keep the foreign materials from clogging the second and third filters 53 and 54.

A washing cycle of the dishwasher will now be described.

Clean washing water is supplied to the sump 20 from an external source. When the washing pump 70 is driven, the clean washing water from the sump 20 may be simultaneously or selectively supplied to the top nozzle 15, the upper nozzle 16, and the lower nozzle 17 through the washing pump 70 and the channel opening and closing device 80. The clean washing water may mix with wash agents to wash items received in the racks 13 and 14, and is then returned to the sump 20 so that foreign materials may be filtered from the washing fluid by the suction force of the washing pump 70 as it passes through the filter device 50. Thereafter, the filtered washing fluid may again be supplied to the tub 11 through the washing pump 70 and the channel opening and closing device 80. The washing process may be repeated several times, as appropriate.

During the washing process, some of the washing fluid may flow through the branch channel 110, and into the first, second, and third branch parts 111, 112, and 113, where it is directed onto the second and third filters 53 and 54. In this process, the foreign materials accumulated in the second and third filters 53 and 54, in particular, the foreign materials accumulated in the third filter 54, may be separated from the second and third filters 53 and 54.

Figure 7:
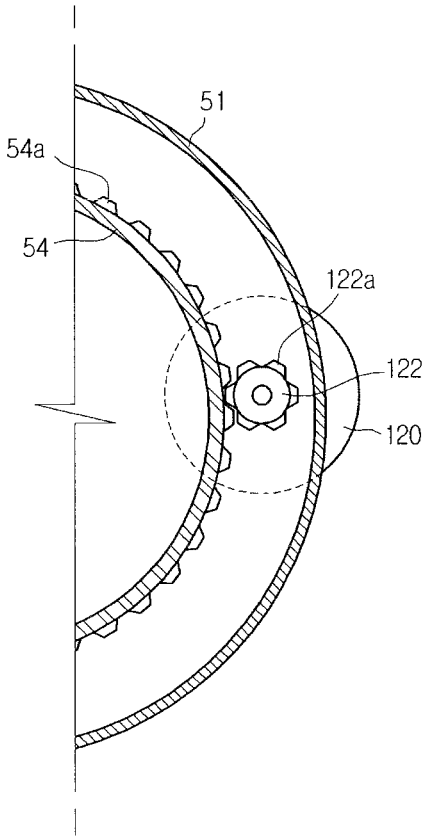
FIG. 7 is a cross-sectional view taken along line IV-IV' of FIG. 6.
Figure 8:
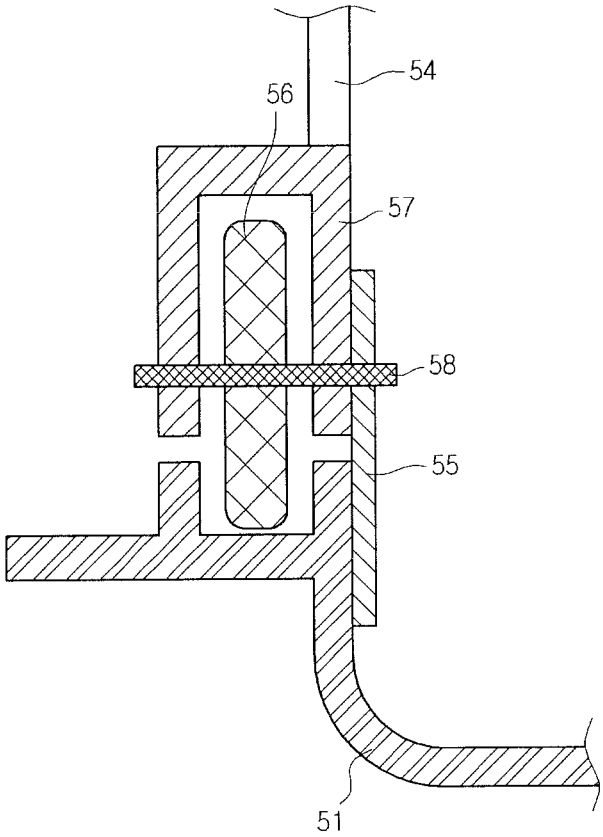
FIG. 8 is a cross-sectional view taken along line V-V' of FIG. 6.

Referring to FIGS. 7 and 8, the filter device 50 may include a driver and a power transfer device that generate and transfer a driving force to the second filter 54.

In detail, the driver may include a rotating motor 120 that provides a rotating force to the third filter 54. The rotating motor 120 may be provided below the filter housing 51. The power transfer device may include a motor gear 122 connected to an upper portion of the rotating motor 120 and in communication with the third filter 54. A motor shaft that connects the rotating motor 120 to the motor gear 122 may extend upward through the filter housing 51.

An outer circumferential surface of the third filter 54 may include first gear teeth 54*a*, and an outer circumferential surface of the motor gear 122 may include second gear teeth 122*a* that engage the first gear teeth 54*a*, so that when the rotating motor 120 is driven, the motor gear 122 is rotated and thus, the third filter 54 may be rotated in an opposite direction to the motor gear 122 through the engagement of the teeth 54*a* and 122*a*.

A rotating guide for guiding the movement of the third filter 54 may include a wheel 56, a wheel housing 57 that receives the wheel 56, and a wheel shaft 58 that is connected to the wheel housing 57 and serves as an axis of rotation of the wheel 56. The wheel 56, wheel housing 57 and wheel shaft 58 may be provided at a lower end of the third filter 54.

The filter housing 51 may include a guide groove 51*c* that guides the movement of the wheel 56 so that the wheel 56 may be rotated clockwise or counterclockwise along the guide groove 51*c*. The wheel housing 57 may cover the outer side of the wheel 56 above the guide groove 51*c*, and the third filter 54 may extend upward from an upper end of the wheel housing 57. A seal 55 may be provided at an inner side of the wheel housing 57 to form a seal between the wheel housing 57 and the filter housing 51 and prevent washing fluid in the filter device 50 from leaking to the outside through a gap therebetween.

Timing a driving of the rotating motor 120 now will be described.

The operation cycle of the dishwasher may include washing, rinsing, and drying steps. The washing step may include a water supply process in which clean water is supplied from an external source, a washing process that washes items using the supplied washing water mixed with a wash agent, a rinsing process, and a draining process that discharges accumulated foreign materials and the used washing fluid. In the washing process, a process in which washing fluid is supplied to the sump, filtered, and re-supplied to the washer, may be repeated several times. In the cycle of the dishwasher, the third filter 54 may be rotated at a point before the draining process starts. In other words, the draining pump 90 may be driven after the rotating motor 120 is operated. When the draining pump 90 is driven after the rotating motor 120 is driven and the foreign materials accumulated in the third filter 54 are separated from the third filter 54 by the washing fluid from the nozzles 115, foreign materials may be easily discharged through the draining device 59 together with the used washing fluid.

In an initial washing process, the rotating motor 120 may be driven. Since the initial washing process is likely to collect a relatively large amount of foreign materials in the filter device 50, the rotating motor 120 may rotate the third filter 54 to separate the foreign materials from the filter device 50. On the other hand, during the rinsing process, where the collection of the foreign materials is likely to be relatively small, the driving of the rotating motor 120 may be stopped.

Figure 6:
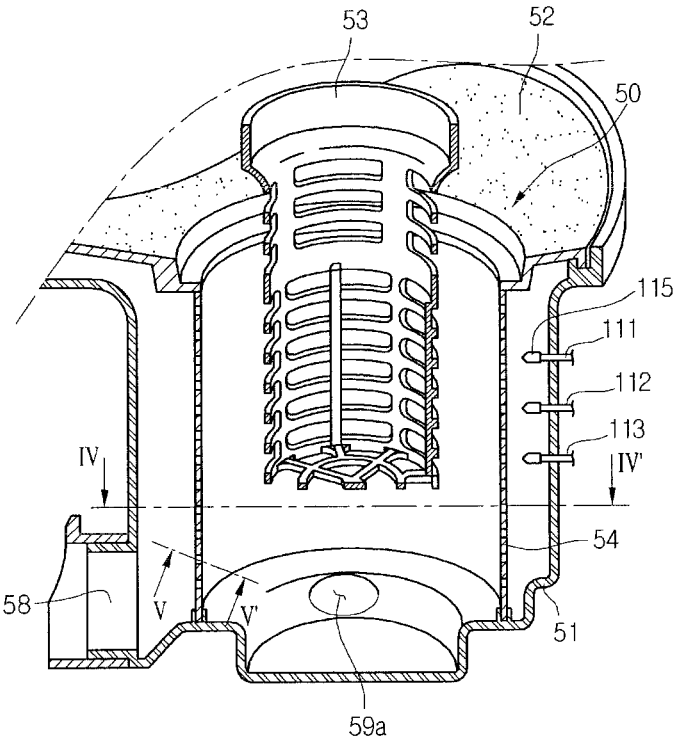
FIG. 6 is a cross-sectional view of a filter device of the dishwasher shown in FIG. 1.
Figure 9:
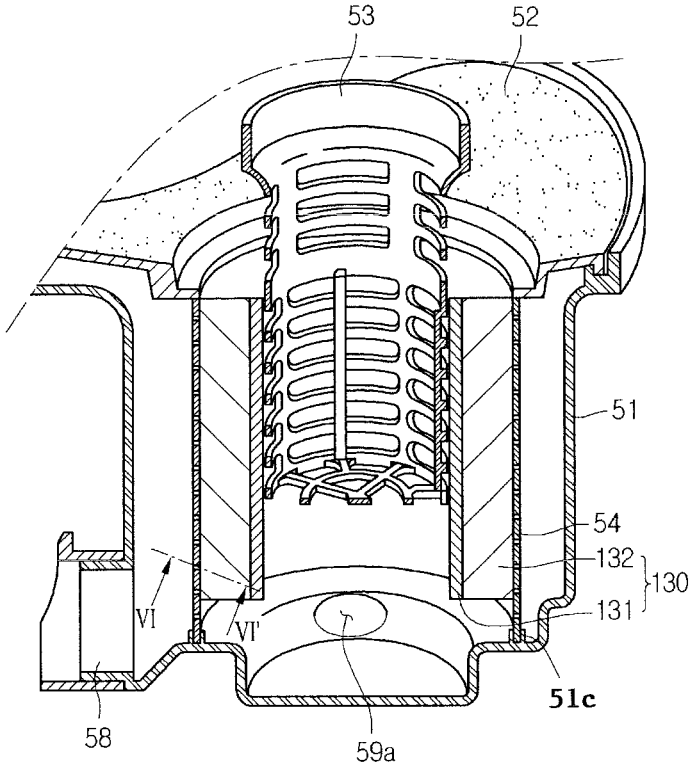
FIG. 9 is a cross-sectional view of a filter apparatus of the dishwasher according to another embodiment as broadly described herein.
Figure 10:
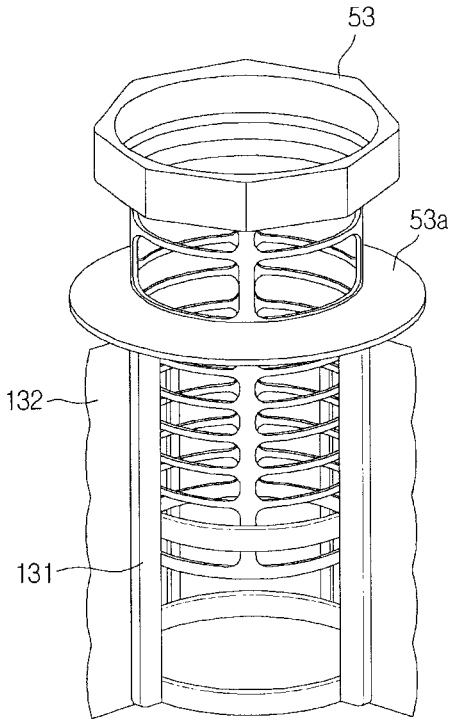
FIG. 10 illustrates a coupling of a second filter and a cleaning device shown in FIG. 9.
Figure 11:
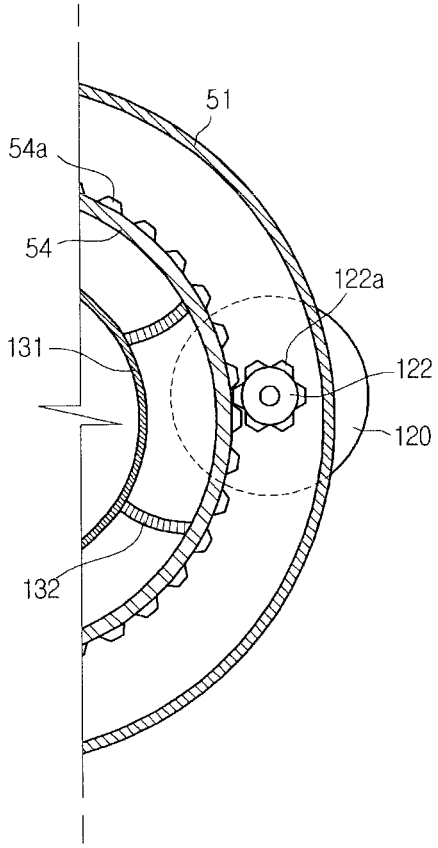
FIG. 11 is a cross-sectional view taken along line VI-VI' of FIG. 9.

The embodiment shown in FIGS. 9-11 includes a slightly different rotating structure as compared to the embodiment shown in FIGS. 6-8.

Referring to FIGS. 9-11, the filter device 50 includes the first filter 52, the second filter 53, and the third filter 54 as described above. The filter device 50 also includes a cleaning device 130 positioned between the second filter 53 and the third filter 54 so as to contact an inner circumferential surface of the third filter 54.

The third filter 54 may be rotatably installed in the filter housing 51. The second and third filters 53 and 54 and the filter housing 51 may have a substantially cylindrical shape. The lower end portion of the third filter 54 may be received in a guide groove 51*c* formed in the filter housing 51. The third filter 54 may be rotated clockwise or counterclockwise along the guide groove 51*c*.

A driver and a power transfer unit may be provided with the filter device 50 to rotate the third filter 54. The driver includes the rotating motor 120 provided below the filter housing 51 to provide a rotating force to the third filter 54. The power transfer unit includes the motor gear 122 provided above the rotating motor 120 so as to be rotated in a predetermined direction in response to the driving of the rotating motor 120. First gear teeth 54*a* formed on the outer circumferential surface of the third filter 54 engage with second gear teeth 122*a* formed on the outer circumferential surface of the motor gear 122 so that the third filter 54 may be rotated in an opposite direction to the motor gear 122.

The cleaning device 130 may be coupled with the outer side of the second filter 53 that faces the third filter 54. The cleaning device 130 may include a fixing frame 131 that is coupled with the outer side of the second filter 53 and one or more blades 132 positioned along the circumference of the fixing frame 131. An outer circumferential surface of the fixing frame 131 may have a substantially cylindrical shape to correspond to the second filter 53 and the third filter 54.

The fixing frame 131 may be installed in the filter housing 51 and may be spaced apart by a predetermined distance from the third filter 54. The one or more blades 132 may extend outward from outer side of the fixing frame 131 so that distal end portions of the blades 132 contact an inner circumferential the third filter 54. If a plurality of blades 132 are provided, the plurality of blades 132 may be spaced from each other along the outer circumferential surface of the frame 131, either at regular intervals or at different intervals as appropriate.

The second filter 53 may include a supporting part 53*a* that is supported on an upper side of the cleaning device 130. The cleaning device 130 may be stably coupled to the outside of the second filter 53 so as to support the supporting part 53*a*. The blade 132 scrapes the inner circumferential surface of the third filter 54 as the third filter 54 rotates, and foreign materials stuck in the third filter 54 may be separated from the third filter 54.

The third filter 54 may be rotatably installed in the filter housing 51, and the cleaning may be positioned between the second filter 53 and the third filter 54 so as to clean the third filter 54 as the third filter 54 rotates, thereby making it possible to prevent the third filter 54 from clogging due to foreign materials. The one or more blades 132 may be made of a deformable material such as, for example, a rubber or deformable plastic material. Other materials including rigid materials, may also be appropriate. However, deformable blades 132 may prevent damage to the third filter 54 as the blades 132 contact the third filter 54.

Figure 12:
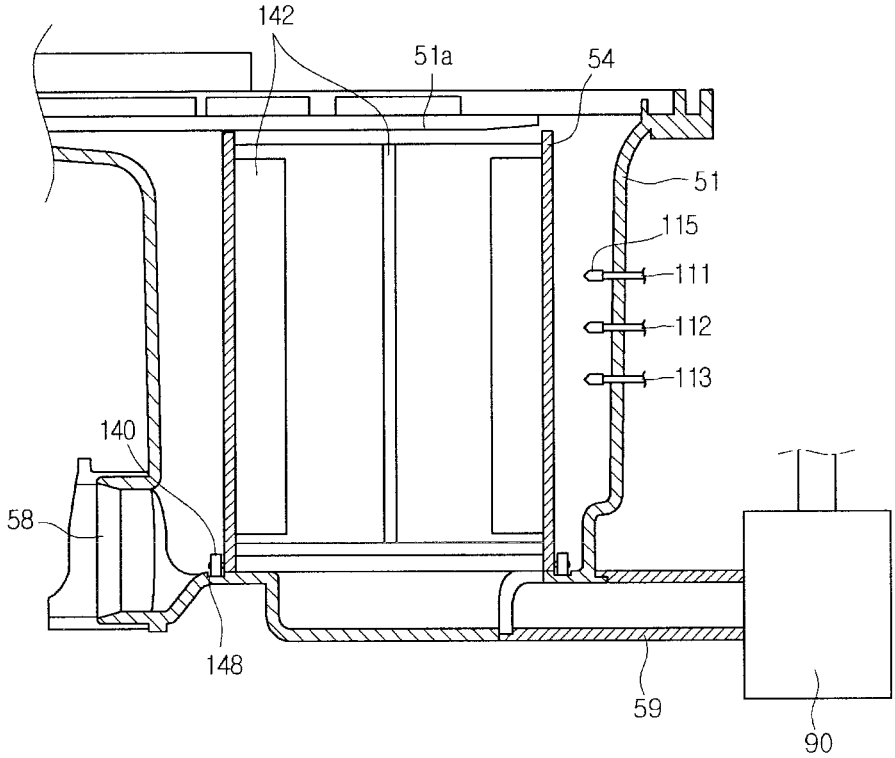
FIGS. 12 and 13 are cross-sectional views of a filter apparatus of a dishwasher according to another embodiment as broadly described herein.
Figure 13:
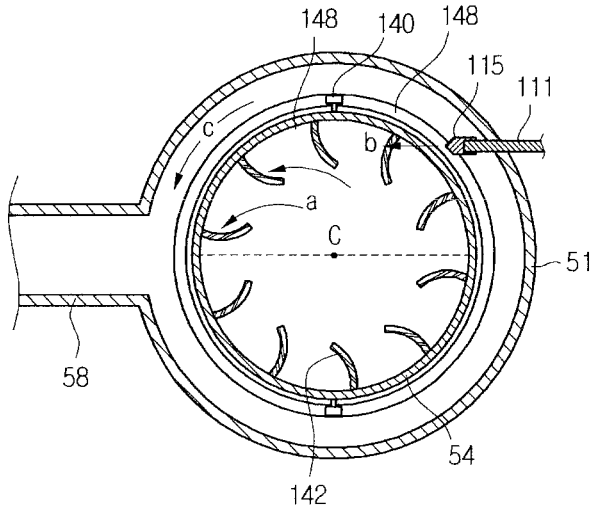

A filter device of a dishwasher in accordance with another embodiment as broadly described herein is shown in FIGS. 12 and 13. The filer device 50 shown in FIGS. 12 and 13 includes the third filter 54 rotatably received in the filter housing 51 and the plurality of nozzles 115 directed toward one side of the third filter 54, with the filter housing 51 and the third filter 54 having a substantially cylindrical shape. The second filter 53 may be positioned at an inner side of the third filter 54, as described above.

A roller 140 may be provided at a lower portion of the outer side of the third filter 54, positioned within a guide groove 148 formed at an inner lower portion of the housing 51, to guide the rotation of the roller 140 and subsequent rotation of the third filter 54 to which the roller 140 is coupled.

A plurality of filter blades 142 may be arranged along the inner side of the third filter 54, and pressurized by the washing directed thereon from the nozzles 115. The plurality of filter blades 142 may be spaced from each other along the inner circumferential surface of the third filter 54 and may extend toward a center C of the third filter 54 from the inner circumferential surface of the third filter 54. The filter blades 142 may be rounded, having a predetermined curvature, so that the washing fluid from the nozzles 115 is easily pressurized and foreign materials stuck in the third filter 54 may be removed by the pressure of the washing fluid from the nozzles 115. As described above, the filter inlet 51*a* supplies washing fluid from the sump 20 to the filter device 50, and the suction force of the washing pump 70 is applied at the pump inlet 58.

The operation according to the embodiment shown in FIGS. 12 and 13 will be now described.

As described above, the nozzles 115 direct a part of the washing fluid pumped by the washing pump 70 toward the filter device 50 while the washing pump 70 is driven. However, the driving of the washing pump 70 may be stopped during the draining cycle. Therefore, washing fluid is not directed through the nozzles 115 when the draining pump 90 is operated.

In detail, when the driving of the washing pump 70 starts, a flow of washing fluid toward the pump inlet 58 is generated in the filter device 50 by the suction force (pumping force) of the washing pump 70. Therefore, washing fluid stored at an upper portion of the sump 20 is supplied to the inside of the filter device 50 and pressurizes at least one surface of the filter blade 142 as the washing fluid is drawn toward the pump inlet 58, in a direction "a" shown in FIG. 13. Consequently, the third filter 54 may be rotated by the suction force of the washing pump 70, which serves as a driving force. The washing fluid sprayed from the nozzles 115 may also pressurize at least one surface of the filter blade 142, in the direction "b" shown in FIG. 13, and therefore, the rotation of the third filter 54 in the direction "c" may be more easily performed. The spray from the nozzles 115 may also operate particles from the third filter 54 as the third filter 54 rotates.

As described above, the third filter 54 may be easily rotated by the suction force of the washing pump 70 and the fluidic force generated by the nozzles 115 so that foreign materials may be separated from the third filter 54 by the nozzles 115 and from the second filter 53 by the blades 142.

Figure 14:
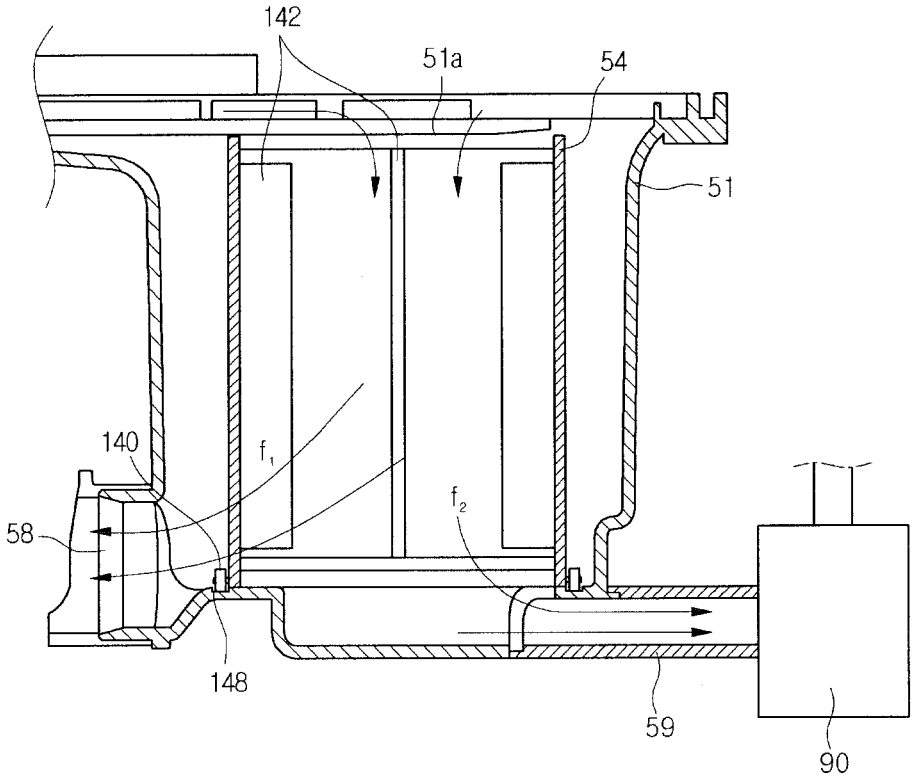
FIGS. 14 and 15 are cross-sectional views of a filter apparatus of a dishwasher according to another embodiment as broadly described herein.
Figure 15:
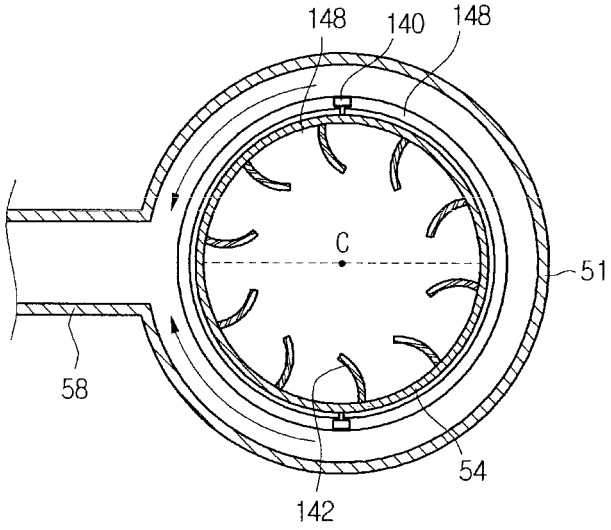

A filter device of a dishwasher in accordance with another embodiment as broadly described herein is shown in FIGS. 14 and 15. The filter device 50 shown in FIGS. 14 and 15 includes the third filter 54 rotatably installed the filter housing 51, with the roller 140 that is rotated along the guide groove 148 coupled thereto. The pump inlet 58 supplies washing fluid from the filter inlet 51*a* to the washing pump 70 in the washing cycle, and the draining device 59 discharges the used washing fluid and foreign materials to the outside in the draining cycle.

In the washing cycle, when the washing pump 70 is driven, washing fluid flows from the filter inlet 51*a* to the pump inlet 58, in the direction "f1" shown in FIG. 14. The flow of the washing fluid in the f1 direction may be applied to the plurality of filter blades 142 and in this process, the third filter 54 may be rotated in a predetermined direction. Simply for ease of discussion, the washing fluid flowing in the f1 direction may correspond to a counterclockwise rotation of the third filter 54.

On the other hand, in the draining cycle, when the draining pump 90 is driven, the washing fluid may flow to the draining device 59, in the direction "f2" shown in FIG. 14. The flow of the washing fluid in the f2 direction may be applied to the plurality of filter blades 142 and in this process, the third filter 54 may be rotated in a predetermined direction. Simply for ease of discussion, the washing fluid flowing in the f2 direction may correspond to a clockwise rotation of the third filter 54.

Thus, the rotating direction of the third filter 54 may be changed based on whether the washing pump 70 or the draining pump 90 is operated, and foreign materials accumulated in the filter device 50 may be easily separated according to rotation of the filter in a clockwise or counterclockwise direction.

A dishwasher is provided that prevents a filter from clogging due to foreign materials by improving a structure of a sump.

A dishwasher is provided that cleans foreign materials in a filter during the rotation of the filter.

A dishwasher according to an embodiment as broadly described herein may include a washing space including a rack in which dishes are received and a nozzle that injects washing water; a sump in which the washing water supplied to the washing space is collected; a filter unit including a first filter that is provided inside the sump and has a plurality of fine holes and a second filter that has a plurality of fine holes smaller than the fine holes of the first filter; and a driving unit that provides a rotating force to the second filter.

A dishwasher according to another embodiment as broadly described herein may include a washing space including a rack in which dishes are received and a nozzle that injects washing water; a sump in which the washing water supplied to the washing space is collected; a filter unit that is disposed inside the sump; a driving unit that makes the filter unit and the sump perform a relative motion with respect to each other; a filter housing that forms a part of a lower end of the sump; and a guide unit that is provided in the filter housing and guides the motion of the filter unit.

A dishwasher according to another embodiment as broadly described herein may include a washing space including a rack in which dishes are received and a nozzle that injects washing water; a sump in which the washing water supplied to the washing space is collected; a washing pump that is adjacently disposed at the sump and pumps the washing water to the washing space; a filter unit including a first filter that forms a part of a lower end of the washing space and has a plurality of holes having a first size, a second filter that is provided inside the sump and has a plurality of holes having a second size larger than the first size, and a third filter that is provided inside the sump and has a plurality of holes smaller than the first size; a pump inlet that is mounted on one side of the sump and is supplied to the washing water passing through at least one filter in the filter unit to the washing pump; and a driving unit that moves the third filter.

In a dishwasher as embodied and broadly described herein, the filter may be rotatably provided and the foreign materials may be separated from the filter during the rotation of the filter.

In addition, washing fluid may be directed to the filter by redirecting a portion of the washing fluid pumped by the washing pump such that the filter cleaning may be easily performed by a simple structure improvement.

Further, the surface of the filter may contact the cleaning unit during the rotation of the filter, thereby making it possible to easily remove the foreign materials attached to the filter.

Moreover, the filter may be easily rotated by the suction force of the washing pump and the foreign materials may be effectively cleaned during the rotation of the filter.

Also, the foreign materials lodged in the filter may be effectively dislodged and the flow of washing fluid may be smooth, thereby making it possible to improve washing performance. The foreign materials are removed from the filter surface to prevent the filter from clogging, thereby making it possible to improve filtering performance.

Further, the foreign materials separated from the filter may be easily discharged to the outside of the dishwasher during a draining cycle, thereby making it possible to prevent a bad odor in the washer due to the decay of the foreign materials.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher, comprising:

a rack positioned in a washing space and at least one washing space nozzle that directs washing fluid into the washing space;

a sump that collects washing fluid to be supplied to the washing space;

a filter to filter foreign materials, the filter comprising a first filter and a second filter rotatably mounted outside the first filter;

a filter housing that receives the first and second filters therein;

a motor positioned at one side of the filter housing;

a shaft connected to the motor;

a first gear coupled to the shaft so as to receive a driving force from the motor; and a second gear provided at an outer circumferential surface of the second filter to communicate with the first gear, wherein the second filter rotates in one of a clockwise or a counter-clockwise direction in response to operation of the motor to allow the first gear to rotate in the other of the clockwise or counter-clockwise direction.

2. The dishwasher of claim 1, wherein the first gear comprises a plurality of first teeth formed on an outer circumferential surface thereof, and the second gear comprises a plurality of second teeth formed on a lower portion of an outer circumferential surface of the second filter, wherein the plurality of first teeth are configured to respectively engage the plurality of second teeth.

3. The dishwasher of claim 1, further comprising:

a main channel that receives washing fluid from a storage chamber separated from the sump;

a plurality of auxiliary channels that branch out from the main channel so as to receive washing fluid from the main channel; and a plurality of cleaning nozzles respectively provided at distal ends of the plurality of auxiliary channels, wherein the plurality of cleaning nozzles direct washing fluid from the plurality of auxiliary channels onto the second filter.

4. The dishwasher of claim 3, further comprising a washing pump in fluid communication with the sump, wherein the washing pump pressurizes washing fluid in the sump and pumps washing fluid from the sump to the at least one washing space nozzle, and to the plurality of cleaning nozzles via the main channel and the plurality of auxiliary channels.

5. The dishwasher of claim 4, wherein the washing pump is positioned adjacent to the sump, and wherein the washing pump pressurizes washing fluid in the sump so as to supply washing fluid to the at least one washing space nozzle, and wherein a flow of washing fluid through the sump generated by operation of the washing pump generates a fluid force that rotates the second filter.

6. The dishwasher of claim 3, further comprising at least one filter blade that extends from an inner circumferential surface of a substantially cylindrical filter body of the second filter toward a center of the second filter.

7. The dishwasher of claim 6, wherein the second filter rotates in response to a flow of washing fluid through the filter housing that pressurizes the at least one filter blade.

8. A dishwasher, comprising:

a washing space;

a sump in which washing fluid supplied to the washing space is collected;

a filter device positioned in the sump the filter device comprising a first filter and a second filter;

a filter housing in which the filter device is received, wherein the filter housing forms a lower end portion of the sump;

a driving system that moves the filter device relative to the sump; and a guide system provided in the filter housing to guide the motion of the filter device, the guide system comprising a guide groove formed in the filter housing so as to receive a motion device coupled to the second filter, wherein the motion device comprises:

a wheel housing provided at a lower end of the second filter; and a wheel that is rotatable coupled to the wheel housing and is positioned in the guide groove.

9. The dishwasher according to claim 8, further comprising a seal that extends between the wheel housing and the filter housing so as to form a seal therebetween.

10. The dishwasher of claim 8, further comprising an injection system provided in the filter housing, wherein the injection system injects onto the filter device so as to separate foreign materials from the filter device.

* * * * *